United States Patent [19]

Cherrington

[11] 3,967,689

[45] July 6, 1976

[54] REAMING APPARATUS

[75] Inventor: Martin D. Cherrington, Sacramento, Calif.

[73] Assignee: Tidril Corporation, Sacramento, Calif.

[22] Filed: Sept. 25, 1974

[21] Appl. No.: 508,964

[52] U.S. Cl. ..... 175/391; 61/72.1; 175/53; 175/406; 175/413

[51] Int. Cl.[2] ..... E21B 9/22

[58] Field of Search ..... 61/72.7, 72.6, 72.1; 175/391, 392, 53, 61, 62, 390, 384, 406, 413

[56] References Cited

UNITED STATES PATENTS

| | | | |
|---|---|---|---|
| 1,659,327 | 2/1928 | Montgomery | 175/406 |
| 1,848,762 | 3/1932 | Atkinson | 175/406 X |
| 2,775,439 | 12/1956 | McCarthy | 175/391 X |
| 2,780,439 | 2/1957 | Kandle | 175/391 |
| 2,783,974 | 3/1957 | Veasman | 175/391 X |
| 2,839,271 | 6/1958 | Kandle | 175/53 |
| 2,915,290 | 12/1959 | Petersen | 175/392 |
| 3,208,537 | 9/1965 | Scarborough | 175/53 |
| 3,554,303 | 1/1971 | Zajkowski | 175/390 X |
| 3,589,135 | 6/1971 | Ede | 61/72.2 X |

FOREIGN PATENTS OR APPLICATIONS

| | | | |
|---|---|---|---|
| 1,232,414 | 4/1960 | France | 175/385 |
| 1,427,180 | 12/1965 | France | 175/406 |

*Primary Examiner*—Dennis L. Taylor

*Attorney, Agent, or Firm*—Townsend and Townsend

[57] ABSTRACT

A frusto-conical multi-stage reamer constructed from a sequence of reamer stages is disclosed. Each reamer stage includes a central stem having a coupling at the leading end and a coupling at the trailing end. A plurality of circumferential arms extend from the central stem of each reamer stage and are inclined in a common direction with respect to the axis of the stems. The free ends of the arms are directed outwardly and forwardly with respect to the stem, and individual reamer teeth are attached to the free end of each arm. The radial extent of the arms of each stage of the sequence is a preselected increment greater than the radial extent of the arms of each preceding stage. In operation, the reamer stages are connected in sequence by the aforesaid couplings and simultaneously rotated and pulled through a pilot hole to produce an enlarged aperture.

8 Claims, 4 Drawing Figures

FIG_1
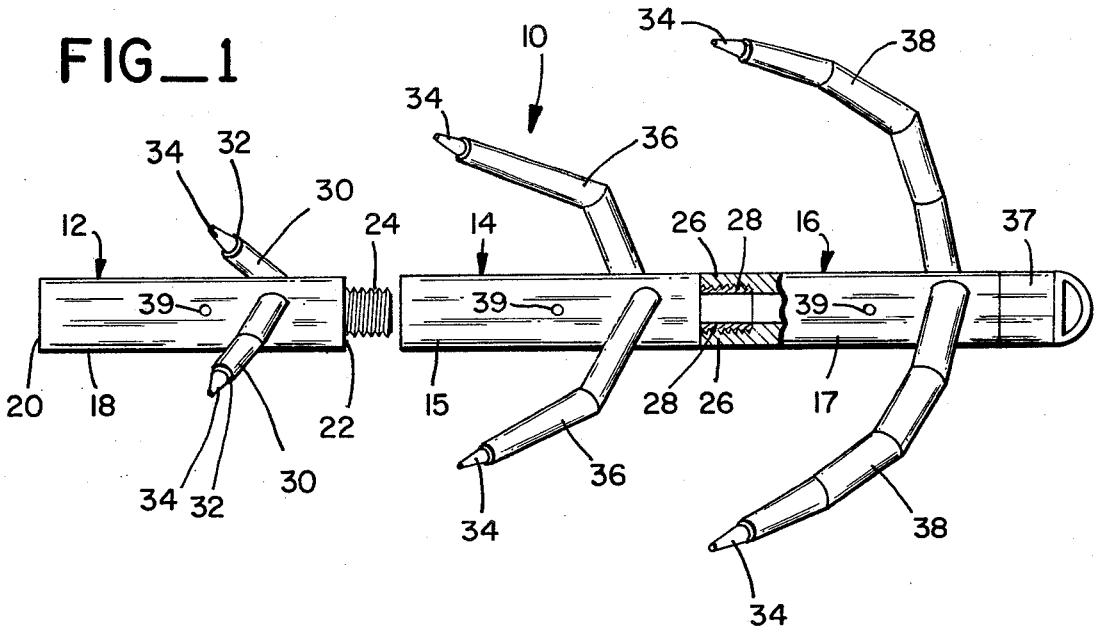
FIG_2
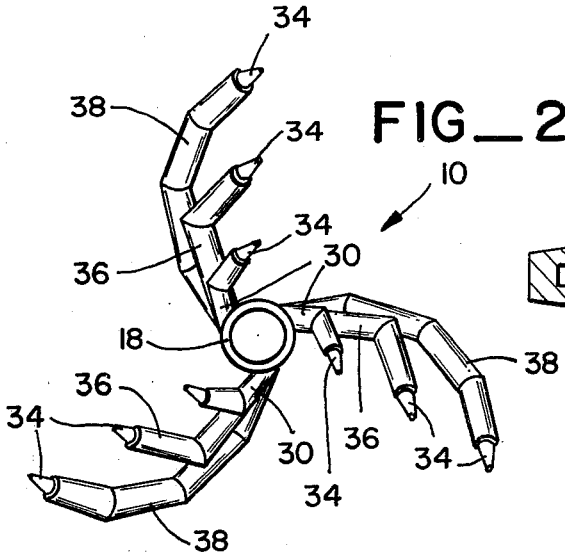
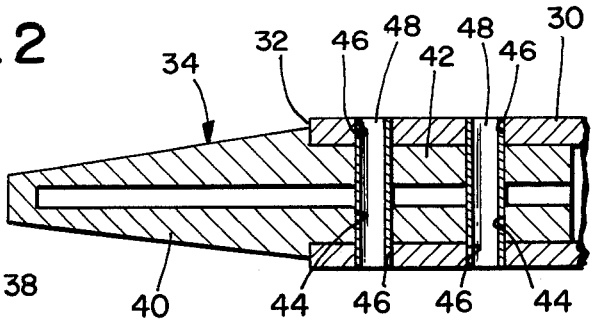
FIG_3
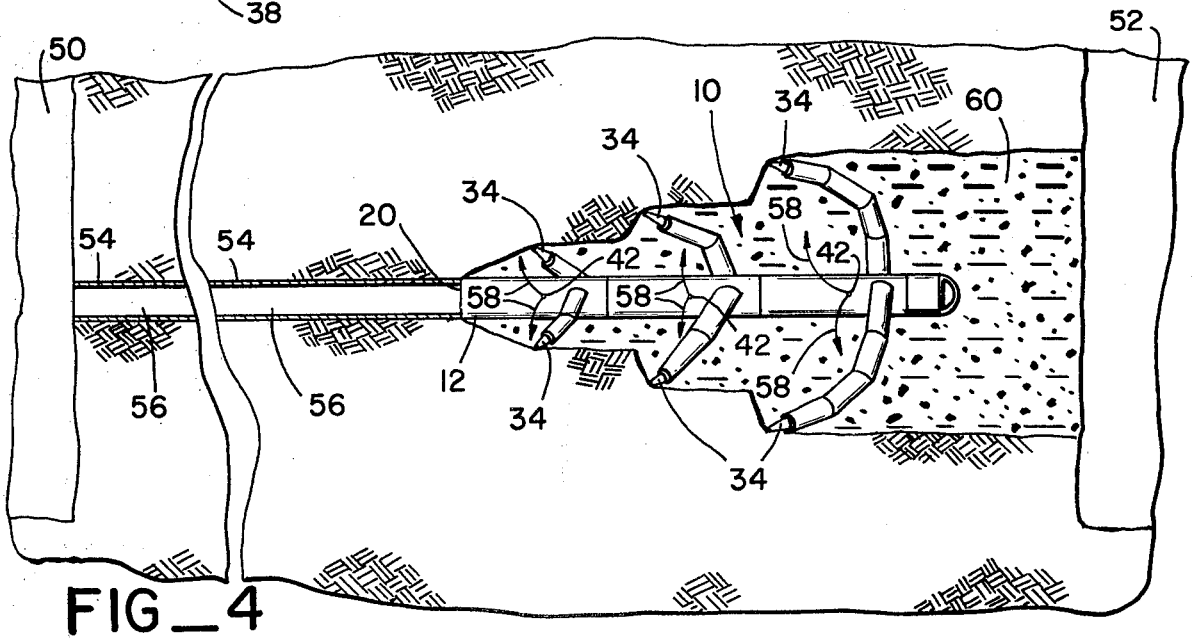
FIG_4

REAMING APPARATUS

BACKGROUND OF THE INVENTION

The present invention relates to a reamer assembly, and in particular to a multi-stage reamer assembly providing a frustro-conical array of individual reamer teeth.

In urban areas, it is often necessary to place a production casing for telephone lines, water mains and the like under existing road surfaces. The customary method for providing an underground hole large enough to contain such a casing involves several steps. First a small diameter pilot hole is drilled along the desired path of the casing with a drill having a trailing drill string. Then, a reamer having a slightly larger diameter than the pilot hole is attached to the drill string and run through the pilot hole to enlarge it. After the first reamer pass, a slightly larger reamer is attached to the drill string and used to further enlarge the hole. This process is repeated until the hole has reached the desired diameter. With this method, the reamers can either be pulled or pushed through the hole by the drill string on each pass.

In the customary method for enlarging a pilot hole to the desired diameter to accommodate a casing, the drill string is ordinarily chosen to have a diameter slightly less than the pilot hole bored by the drill bit. When successively larger reamer stages are added, the same drill string is used for convenience and the diameter of the drill string is not increased. As a result, when successively larger reamers are pulled through the pilot hole, the drill string is not flush with the sides of the hole and does not provide a guide for the reamer. The reamer will follow the path of the least resistance around rocks and other obstructions and the reamed hole will not be coaxial with the pilot hole and can have curves and bends along its length. If the reamer is pushed through the pilot hole, the drill string provides no guide whatsoever and again the reamer will follow the path of least resistance. An added difficulty with pushing a reamer through a hole to enlarge it is that the relatively thin drill string is potentially subject to columnar failure especially when larger reamers are used.

In urban areas wherein a large number of such conduits are often placed in a limited area, exact placement of the production casing between other casings already in place is often required, and this exact placement cannot be achieved with customary tools and methods for forming such holes. Furthermore, the hole will often be curved making it difficult to place a straight production casing in the hole. Hence, while such tools and methods are often used in the placement of pipelines or other conduits, a variety of difficulties usually arise in the course of such use.

The use of multi-stage reamers has recieved little attention in the prior art. A variety of multi-stage drills are illustrated in the prior art, such as those illustrated in the patents of Kandle, U.S. Pat. No. 2,780,439, and the patent to Seidlmayr, U.S. Pat. No. 2,815,935. However, these drills have a corkscrew-shaped surface which is used to pass the drilling earth along the axis of the drill as the drill is being used to bore a hole. As a result, these drills provide a solid surface spanning the entire diameter of the hole when viewed axially. This configuration is acceptable in drilling a fresh hole such as a pilot hole, but cannot be readily adapted for use as a reamer because clays commonly found in many areas will ball up in front of the reamer to fill the pilot hole and block the progress of the reamer. As a result, multi-stage drills known in the prior art have not and cannot be efficiently adapted for use as a reamer.

SUMMARY OF THE INVENTION

The present invention provides a multi-stage reamer which is constructed from a sequence of reamer stages. Each reamer stage includes a central stem having a coupling at the leading end and a coupling at the trailing end. A plurality of arms extend outwardly from the central stem of each reamer stage. The free ends of the arms are directed outwardly and forwardly with respect to the stem and are each inclined to the side in a common direction with respect to the axis of the stem. The individual reamer teeth are attached to the free end of each arm. The radial extent of the arms of each stage of the sequence is a preselected increment greater than the radial extent of the arms of each preceding stage. When the reamer stages are connected in sequence by the aforesaid coupling means, a reamer is provided which has a frustro-conical array of inclined reaming teeth.

The present invention allows for the reaming of a pilot hole to the desired diameter to accomodate a production casing in a single pass, eliminating the need for multiple passes as required by the prior art. The smaller leading end of the frustro-conical reamer is attached to the drill string after the pilot hole has been drilled, without withdrawing the drill string from the hole, and the reamer is pulled back through the hole with the drill string. Since the drill string is approximately the same diameter as the pilot hole, the drill string provides a guide for the reamer and the larger hole is almost exactly coaxial with the pilot hole. Since the reamer is pulled through the hole, there is no possibility of columnar failure. of the drill string and a relatively small drill string can easily operate a much larger reamer.

The present invention provides a sequence of reamer stages, each of which has a radial extent different from the other stages. In order to ream a pilot hole of a given diameter to a preselected larger diameter, the particular reamer stages best adapted to provide such enlargement can be selected, and the particular reamer configuration desired for each application can be easily constructed from a stock of successively larger reamer stages.

The reamer of the present invention is ordinarily used to place a conduit beneath the surface of the ground between two potholes. The pilot hole is drilled from one of the potholes to the other, and when the drill bit exits the pilot hole, it can be removed and replaced with the reamer of the present invention. When the reamer is drawn back through the hole, drilling mud is injected through the drill string to exit at the reamer. The drilling mud entrains the earth which is scarified and dislodged earth easily passes between the arms of the reamer of the present invention so that the reamed hole is filled with the drilling mud containing the dislodged earth. When the production casing is thereafter inserted in the reamed hole, the drilling mud containing the loosened earth is easily displaced by the production casing and it slips easily into the pilot hole.

Another advantage of the reamer of the present invention in practice is that in crowded urban areas, the tolerance through which a casing is to be inserted between prior existing pipes is usually quite small. Often, the pilot hole is not drilled with sufficient precision and the reamer will contact existing piping along the length of the hole. When a reamer having a solid frontal surface encounters such a pipe, the reamer becomes jammed and the pilot hole must be re-drilled. However, with the reamer of the present invention, a space is provided between the reaming teeth so that the reamer can be worked from side to side past existing pipes and the hole completed.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a partially exploded view of the reaming apparatus of the present invention;

FIG. 2 is a front view of the reaming apparatus of the present invention when fully assembled;

FIG. 3 is a fragmentary cross sectional view illustrating attachment of the reamer teeth to the arms of the reamer assembly;

FIG. 4 is a side elevation view of the reaming apparatus of the present invention in operation.

DESCRIPTION OF THE PREFERRED EMBODIMENT

A three-stage reamer assembly 10 constructed in accordance with the present invention is illustrated by way of reference to FIG. 1. The leading stage 12 of reamer assembly 10 is shown broken away from subsequent stages 14, 16 respectively. Leading reaming stage 12 includes a hollow central stem 18 having a leading end 20 and a trailing end 22. Leading end 20 has a tapped female connecting element (not shown) and trailing end 22 includes a male connecting element 24 complementary to the female connecting element at the leading end. Reamer stages 14, 16 similarly have tapped female connecting elements at the leading ends of their respective central stems 15, 17 such as tapped female element 26. Each female connecting element such as 26 is adapted to connect to corresponding male connector elements such as element 28 or stage 14 or element 24 of stage 12 as illustrated in the attachment of stages 14 and 16.

Leading reamer stage 12 has three circumferential arms 30 which extend outwardly from central stem 18. Each arm 30 includes a pair of tubular segments extending from stem 18 and terminating in free ends 32. Individual reaming teeth 34 are fitted to the free ends 32 of arms 30 as will be illustrated in more detail hereinafter. Similarly, stages 14, 16 have three circumferential arms 36, 38 respectively each having two or more tubular segments. Individual reaming teeth 34 are also attached to the free ends of arms 36 and 38.

When reamer stages 12, 14 and 16 are attached in series, the hollow central stems thereof form a continuous hollow pipeline. In operation, drilling mud is injected into this hollow interior through a drill string attached to the leading end 20 of leading stage 12 as illustrated below. In order to prevent flow of the drilling mud directly through the reamer, a cap 37 is adapted to connect to the central stem 17 of the trailing stage 16 of the completed assembly. Cap 37 has a tapped connecting element similar to the leading ends of the reamer stages. A plurality of apertures 39 are provided in the side walls of the central stems of reamer stages 12, 14 and 16 adjacent the attachment points of arms 30, 36, 38 so that the drilling mud flows out of the central stems adjacent the reamer teeth 34 to entrain the earth scarified and dislodged by the reamer teeth.

The configuration of the arms of the various reamer stages is apparent from viewing FIGS. 1 and 2 in combination. Arms 30 of the leading reamer stage 12 comprise two tubular segments axially inclined with respect to each other so that the arms have an arcuate configuration. The outermost tubular segment has a free end 32 which is both outwardly and forwardly inclined with respect to central stem 18. Also, this outermost tubular segment of each arm 30 inclined to the side in a common direction with respect to the axis of central stem 18 so that reamer teeth 34 in the leading ends of arms 30 have a corkscrew configuration. Similarly, arms 36 and 38 of subsequent reamer stages 14 and 16 terminate in tubular segments which, in combination with arms 30, provide a frustro-conical array of reaming teeth. Each reaming tooth is directed forwardly and outwardly with respect to the central stem of the reamer, and is also angularly inclined to form a corkscrew arrangement. In this manner, drill teeth 34 will scrape the face of the hole as the reamer moves to dislodge the earth from the hole. When a rock or similar obstacle is encountered, the curvature of the arm will provide resiliency so that the reamer teeth are not fractured and the arms are not broken or bent.

The preferred embodiment of the present invention utilizes three arms such as 30 for each stage, although any number of arms could be used per stage. However, an add number of arms is preferred so that no arm is diametrically opposed to any other arm. This is an advantage in drilling in confined areas where an existing production casing or other obstruction is encountered, since a reamer having an odd number of arms can be worked around the obstacle more easily than one having an even number of arms. With an odd number of arms, the hole can be made slightly egg-shaped and the diameter in one direction can be less than the diameter of the reamer. If an even number of arms are used, the diameter of the hole cannot be less than the diameter of the reamer in any direction. Three arms are preferred because a sufficient number of cutting teeth are provided and extra arms add needlessly to the complexity of the system.

As is apparent from FIG. 2, the use of independent arms 30, 36 and 38 for mounting each reamer tooth 34 results in a reamer assembly having a minimum solid frontal area. The only obstructions in the frontal area circumscribed by the arms is the arms themselves, and the diameter of the arms is small relative to their length. Drilling mud containing earth dislodged by the reamer assembly can freely flow between the arms of reamer assembly 10. The drilling mud thus does not interfere with the progress of the reamer, and the drilling mud remains in the reamed hole as discussed below.

The attachment of each reamer tooth 34 to the leading end of each of the arms, such as leading end 32 of arms 30, is illustrated by way of reference to FIG. 3. Tooth 34 has a cutting portion 40 mounted to an elongate shaft portion 42. Shaft portion 42 has a pair of radial apertures 44 extending all the way therethrough. Similarly, free end 32 of arm 30 has a corresponding pair of radial apertures 46 adapted to register with apertures 44 when shaft portion 42 of tooth 34 is inserted in the hollow free end 32 of arm 30. A pair of roll pins 48 can be inserted in the registering apertures to firmly attach reamer tooth 34 to arm 30. However, when tooth 34 becomes worn and needs replacement, roll pins 48 can easily be removed and the tooth replaced.

The operation of the reamer assembly 10 of the present invention is illustrated by way of reference to FIG. 4. Initially, potholes 50 and 52 are dug into the ground at the opposite ends of the intended conduit. A pilot hole 54 is then drilled having a trailing drill string 56. When the drill bit emerges in pothole 52, it is removed from drill string 56 and the reamer apparatus 10 (greatly enlarged in FIG. 4 for clarity) of the present invention is attached to the drill string. The leading end 20 of leading reamer stage 12 connects to drill string 56, preferably utilizing the female connecting element provided at the leading end of reamer 10. However, if drill string 56 is not already provided with the complementary male connecting element, an adapter for this purpose can be installed and reamer 10 attached to the adapter.

In practice, it is desirable to provide a plurality of reamer stages such as 12, 14 and 16. Each reamer stage differs from each other reamer stage by a selected increment in the radial extent of the arms. Hence, a reamer assembly can be constructed by selecting the appropriate reamer states for a given project, depending on the radius of the pilot hole and the radius of the production casing. The reamer stages can be strung together using any number of such stages, and terminated with a cap 37. Since the reamer stages each contain identical connecting elements at their leading and trailing ends respectively, each reamer stage is attachable to each other reamer stage. In fact, the reamer can be assembled piecemeal and attached to the drill string after it has emerged to pothole 52 and the drill bit has been removed.

After installation of reamer 10 to drill string 56 in pothole 52, the reaming assembly is drawn back through the pilot hole with drill string 56. As drill string 56 is pulled through the pilot hole it is rotated to operate the reamer. Also at the same time, drilling mud is injected into the drill string 56 and passes through the drill string to reamer 10. This drilling mud exits through apertures 42 in the central stem of the reaming apparatus as illustrated by arrows 58 to entrain the earth scarified and dislodged by reamer teeth 34. The drilling mud and dislodged earth form a slurry which fills the reamed pilot hole 60. A production casing can then be inserted in reamed hole 60. The production casing will displace the slurry in the pilot hole and the slurry will serve to lubricate the production casing so that it slips easily into the hole.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention as set forth in the following claims.

What I claim as new is:

1. A reamer stage comprising a central cylindrical stem having a leading end and a trailing end, said leading end having coupling means of a first type and said trailing means having coupling means of a second type complementary to the first type, and a plurality of circumferential arms extending outwardly from and attached to the cylindrical stem, the free ends of said arms being tubular to provide an axial opening at said free ends, each said arm having a generally arcuate shape so that the free ends of said arms are forwardly and outwardly directed with respect to the stem and the free ends of each of the arms are inclined to the side in a common direction with respect to the axis of the stem so that said arms form a corkscrew configuration, and a plurality of reamer teeth, each reamer tooth having a cutting portion and a shaft portion, said shaft portion adapted to mate with the opening in the free ends of the arms so that the cutting portion of each reamer tooth is coaxial with the free end of each associated arm.

2. A reamer stage as recited in claim 1 wherein each said arm comprises a plurality of tubular segments joined end to end and to the shaft, each said segment being progressively axially inclined with respect to each other said segment so that said arms have a generally arcuate shape.

3. A reamer stage as recited in claim 1 wherein the diameter of the tubular arms is small relative to the length of said arms so that the frontal area circumscribed by the arms is substantially free to obstructions whereby drilling mud containing earth scarified and dislodged by the reamer can pass freely through the reamer stage.

4. Apparatus for constructing a multistage reamer adapted to connect to a drill string, said apparatus comprising at least a first reamer stage and a second reamer stage, each reamer stage including a central stem having a leading end and a trailing end, each said leading end having coupling means of a first type and each said trailing end having a coupling means of a first type and each said trailing end having a coupling means of a second type complementary to the first type, each said stage further including a plurality of arms extending from and attached to the central stem and having a generally arcuate shape, the free ends of said arms being directed outwardly and forwardly and inclined to the side in a common direction with respect to the axis of the stem in a corkscrew configuration, the radial extent of the arms of each said second reamer stage being a preselected increment greater than the radial extend of the arms of said first reamer stage, the coupling means of the leading end of each reamer stage adapted to engage with the complementary coupling means of the trailing end of each preceding stage so that two or more such reamer stages can be interconnected in series to form a multi-stage assembly having a frustro-conical configuration.

5. Apparatus as recited in claim 4 wherein the free ends of said arms are directed outwardly and forwardly with respect to the said stem, said free ends being inclined to the side in a common direction with respect to the axis of the stem in a corkscrew configuration.

6. Apparatus as recited in claim 4 and additionally comprising a plurality of individual reamer teeth, each reamer tooth adapted to be connected to the free end of one of the arms to provide a mult-stage reamer having a multiplicity of outwardly and forwardly directed reaming teeth in a generally frustro-conical configuration.

7. A multi-stage reamer assembly comprising a drill string, the trailing end of said drill string having coupling means of a second type; a first reamer stage including a central stem having a leading end and a trailing end, said leading end having coupling means of a first type complementary to said second type so that the leading end of the first reamer stage is detachably attachable to the trailing end of the drill string, the trailing end of the central stem of the first reamer stage having coupling means of a second type, and a plurality of concentric arms extending from and attached to the central stem, the free ends of said arms directed outwardly and forwardly with respect to said stem, and being inclined with respect to said stem in a common direction, the radial extent of each said arm being equal to a preselected distance; a second reamer stage including a central stem having a leading end and a trailing end, the leading end having coupling means of said first type and said trailing end having coupling means of said second type so that the leading end of said second reamer stage is detachably attachable to the trailing end of the first reamer stage, and a plurality of concentric arms extending from and attached to the central stem, the ends of said arms being directed radially outwardly and forwardly with respect to said stem, each said free end being tubular and having a radial aperture therethrough and being inclined with respect to said stem in a common direction, the radial extent of each said arm being a preselected increment greater than said preselected distance; and a plurality of individual reamer teeth attached to the free ends of each of the arms.

8. A multi-stage reamer assembly as recited in claim 7 wherein a central stem of the first and second reamer stages are tubular to provide a central passage common to each of said reamer stages, the central stem of the reamer stages having radial apertures in the side walls thereof adjacent each of the arms, said apparatus additionally comprising a cap having coupling means of said first type so that said cap is mountable on the trailing end of the central stem of the second reamer stage so that drilling mud injected into the drill string flows out through the apertures in the central stem of the stages to entrain earth scarified by the reamer teeth.

* * * * *